US008689877B2

(12) United States Patent
Telfer et al.

(10) Patent No.: US 8,689,877 B2
(45) Date of Patent: Apr. 8, 2014

(54) DOWNHOLE TOOL

(75) Inventors: George Telfer, Aberdeen (GB); James Linklater, Banffshire (GB); James Atkins, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 499 days.

(21) Appl. No.: 13/002,160

(22) PCT Filed: Jul. 16, 2009

(86) PCT No.: PCT/GB2009/050865

§ 371 (c)(1),
(2), (4) Date: Apr. 1, 2011

(87) PCT Pub. No.: WO2010/007434

PCT Pub. Date: Jan. 21, 2010

(65) Prior Publication Data

US 2011/0168404 A1 Jul. 14, 2011

(30) Foreign Application Priority Data

Jul. 16, 2008 (GB) ..... 0812955.3

(51) Int. Cl.
*E21B 37/00* (2006.01)

(52) U.S. Cl.
CPC ..... *E21B 37/00* (2013.01)
USPC ..... 166/311; 166/66.5; 166/99; 175/325.4

(58) Field of Classification Search
USPC ..... 166/311, 66.5, 99; 175/325.4
See application file for complete search history.

(56) References Cited

U.S. PATENT DOCUMENTS

| | | | |
|---|---|---|---|
| 5,699,577 | A | 12/1997 | Rankin |
| 6,354,386 | B1 | 3/2002 | Ruttley |
| 6,591,117 | B1 | 7/2003 | Kim |
| 6,655,462 | B1 | 12/2003 | Carmichael et al. |
| 2005/0274524 | A1 | 12/2005 | Silguero |
| 2006/0011346 | A1 | 1/2006 | Theriot, Sr. |

FOREIGN PATENT DOCUMENTS

| | | | |
|---|---|---|---|
| GB | 2 350 632 | A | 12/2000 |
| GB | 2 364 539 | A | 1/2002 |
| WO | 02/081859 | A1 | 10/2002 |
| WO | 2009/002185 | A1 | 12/2008 |

OTHER PUBLICATIONS

International Search Report issued in PCT/GB2009/050865, mailed on Feb. 25, 2010, 4 pages.
Written Opinion issued in PCT/GB2009/050865, mailed on Feb. 25, 2010, 6 pages.

*Primary Examiner* — Cathleen Hutchins
(74) *Attorney, Agent, or Firm* — Osha Liang LLP

(57) ABSTRACT

A cleaning tool (1) for use in cleaning ferrous material from a wellbore has a magnetic cleaning element (14) mounted to a tool body (2) within a slot (5) using a releasable concealed interference fit fastener assembly (15) comprising a fastener member having a head (16), and a shank (17) with a configured end (18) and a deformable fastener ring (20) adapted to fit closely over the shank, and a press-fit collar (21) adapted to deform the deformable fastener ring upon the configured end of the shank when assembled, and wherein the respective head and collar are each flanged to permit an interference fit with a corresponding contact surface of the tool body around said slot.

30 Claims, 8 Drawing Sheets

DOWNHOLE TOOL

FIELD OF THE INVENTION

The present invention relates to a cleaning tool for use in cleaning ferrous material from a wellbore. In particular, the present invention relates to means for releasably attaching at least one magnet to a cleaning tool.

BACKGROUND TO THE INVENTION

In the oil and gas exploration and production industry, a wellbore or borehole of an oil or gas well is typically drilled from surface to a first depth and lined with a steel casing which is cemented in place. The borehole is then extended and a further section of tubing known as a liner is located in the borehole, extending from the casing to a producing formation, and is also cemented in place. The well is then completed by locating a string of production tubing within the casing/liner, through which well fluids flow to surface.

However, before the well can be completed, it is necessary to clean the lined wellbore and replace the fluids present in the wellbore with a completion fluid such as brine. The cleaning process serves to remove solids adhered to the wall of the casing or liner; to circulate residual drilling mud and other fluids out of the wellbore; and to filter out solids present in the wellbore fluid. A considerable amount of debris in the wellbore and on the surface of the casing/liner comprises rust particles and metal chips or scrapings originating from equipment used in the well and the casing or liner itself.

Various types of cleaning tools are known, one of which is generically referred to as a casing scraper. Tools of this type typically incorporate casing scraper blades designed to scrape the inner surface of the casing/liner, for removing relatively large particles or debris from the surface of the tubing. Whilst it is recognised that it is desirable to utilise such cleaning tools to clean the casing/liner, when a casing scraper is removed from the well, the scraper blades can dislodge further debris into the wellbore fluid, negating the effect of cleaning procedures previously carried out. Similar difficulties have been encountered with other types of cleaning tools, including those having brushes or other abrading surfaces, circulation tools and the like.

In an effort to overcome disadvantages associated with the use of such tools, magnetic well cleaning apparatus has been developed, such as that disclosed in the Applicant's UK Patent Number 2,350,632, which includes a number of magnets. Another magnetic fishing tool is described in U.S. Pat. No. 6,591,117, wherein, large bar magnets are spaced apart around and along a tool body for the purposes of attracting and retrieving metal debris. These magnets may be permanent magnets made of any suitable magnetic material, such as neodymium iron boron, ceramic ferrite, samarium cobalt, or aluminium nickel cobalt. The bar magnets are fitted into recesses in the tool body and arranged to have an area between each magnet for metallic debris to settle. A further such tool is described in U.S. Pat. No. 6,354,386, wherein arcuate magnet assemblies are detachably secured by screws or other similar means to a body to be mounted in a drill string. An alternative fastening arrangement described there for the magnet assemblies uses split retainer rings provided with locking members for securing the magnets on the body.

In use of such fishing tools, ferrous metal and debris present in the wellbore is attracted to the magnets and carried out of the wellbore when the cleaning tool is removed or "tripped" from the well.

An object of the invention is to provide further improvements in tool assembly and design, and in particular one of the objects of the present invention is to provide an improved wellbore cleaning tool. A further object of the invention is to provide improvements in devices for retention of magnets on a wellbore cleaning tool.

SUMMARY OF THE INVENTION

According to a first aspect of the present invention, there is provided a cleaning tool adapted for use in cleaning ferrous material from a wellbore, the cleaning tool comprising:

a tool body; and at least one magnetic element mounted on the tool, wherein said at least one magnetic element is mounted by retention means comprising a deformable fastener.

The retention means may comprise a component which passes through an outer surface of the tool, the component having a portion upon which the deformable fastener is positioned and locked by deformation of the deformable fastener.

Preferably, said deformable fastener is part of a fastener assembly comprising the deformable fastener, a component adapted to provide an interference fit with a corresponding part of a magnetic element, and a former adapted to cooperate with said deformable fastener.

The fastener assembly may comprise a fastener member having a head, a shank with a configured end and a deformable fastener ring adapted to fit closely over the shank, and a press-fit collar adapted to deform the deformable fastener ring upon the configured end of the shank when assembled. Conveniently the deformation involves compression of the ring into one or more grooves in the end of the shank. However, the invention is not restricted to use of that configuration, and any configuration that allows the ring to form an interference fit to lock the collar to the shank is suitable.

Generally the material of the ring is selected such that the deformation is permanent, and the fastener assembly may only then be released by shearing of the ring.

In this way the fastener assembly of the present invention provides a hidden fixing, where the key locking components are internalised within the assembly, and thus tamper-proof.

The magnetic element may comprise an aperture or recess adapted to receive at least the shank of a fastener member of such a fastener assembly, said aperture or recess being sized such that its peripheral edge lies under the head so that the latter is in abutment with one surface of the magnetic element. The fastener member may be retained in the recess by positioning the deformable ring in the aperture around the shank, together with a shaped cup as the former to deform the ring upon the shank to form an interference fit upon the shank. The forming step may be accomplished by applying sufficient axial force to the ring along the shank whereby the ring is deformed against the cup and forced into the groove(s) of the configured end of the shank.

The respective head and collar or cup of the fastener assembly may be flanged to permit an interference fit with a corresponding part of the tool body to allow the fastener assembly to retain the magnetic element in position upon the body. The flange may be bevelled to abut a corresponding chamfered seat in a contact surface in the tool body.

Preferably, said at least one magnetic element is provided with at least one recessed portion for receiving a shank of a fastener member of a fastener assembly.

The tool body is advantageously configured to facilitate fluid flow around the magnetic elements, so that e.g. circulation fluid may by-pass the magnetic elements without significant impediment.

Preferably the tool main body is provided with a plurality of slots for receiving respectively at least one of said magnetic elements.

Preferably the slots are configured to receive such magnetic elements together with respective fastener assemblies such that the heads and collars/cups upon the fastener members abut edges of the slots to retain the magnetic elements in position.

The slots may be provided in ribs extending from a side surface of the tool body. The ribs may extend radially, and may be provided with recessed tool body surfaces between respective ribs.

The tool body surfaces between said ribs serve as catchment areas for ferrous debris, and whilst it is preferred that these are recessed, in some cases this may not be necessary.

Optionally, a channel may be provided between ribs for improved flow of fluids, and the adjacent rib surface may be shielded from magnetic effects so that the channel would be free of ferrous debris. This is achievable in an embodiment by inserting non magnetic elements into selected recesses of the ribs, or substituting selected magnetic cleaning elements with non-magnetic elements. Equally the desired clear channel effect is achievable by adopting suitably shielded magnetic elements i.e. shielded on one surface that would be facing the channel when the element is positioned in the appropriate recess in the rib.

The ribs may be formed with peripheral surfaces to serve as tool body stabilisers, or with peripheral edges to enhance "wipe off" of ferrous debris during use of the tool e.g. on pull out of the hole.

The tool body may have several groups of ribs spaced along the longitudinal axis of the tool body. The respective groups may be mutually radially displaced or offset.

The tool body may comprise a plurality of subs each of which may provide differently oriented supports for magnetic elements, e.g. to take account of flow characteristics around the tool and to maximise distribution of magnetic elements and the effect thereof in normal use of the tool.

The ribs on the tool body may be of any selected length, but typically a rib may sized in the range of 18 to 24 inches (0.45-0.60 meters) in length The fastener assemblies are conveniently applied to the magnetic element by a swaging method.

By appropriate design, a deformable collar can be provided that once deformed to perform a fastening action, may be subsequently sheared by application of force to allow the fastener assembly to be disassembled.

The magnetic element may comprise a permanent magnet, preferably a bar magnet.

The magnetic element optionally may be an electromagnetic component with a magnetisable element.

Typically, in an illustrated embodiment to be described hereinafter the magnets are "lozenge" shaped and are protected e.g. encapsulated in stainless steel to protect them from breakage and corrosion. Additionally, the magnets may be shielded as described in our earlier U.S. Pat. No. 6,655,462.

Optionally the magnets are of other shapes, e.g. curved to fit contours of a cylindrical tool body, or to align with curved ribs.

The magnets may be made of any suitable magnetic material, such as rare earth magnetic materials, optionally associated with flux carrying materials.

Suitable magnetic materials include neodymium iron boron, ceramic ferrite, samarium cobalt, or aluminium nickel cobalt, and the like.

An advantage of the aforesaid invention is that it offers a reliable means of attaching the magnets to the body of the tool that ensures that the magnets will remain in place for use but can be removed from the tool as deemed necessary for tool body inspection purposes.

The invention also avoids the need to use threaded screws or bolts as a fastening means because these are considered too problematical.

Furthermore, the invention to be more particularly described hereinafter provides a "tamper proof" method of fixing the magnets to the tool body.

According to another aspect of the invention there is provided a method of assembling a downhole wellbore cleaning tool to provide a concealed secure fixing for a cleaning element, which method comprises, (i) providing a tool body part, said part having at least one projecting support bearing a slot for receiving a cleaning element, (ii) providing a cleaning element configured to fit within the slot (iii) providing a fastener assembly comprising a deformable fastener, a component adapted to provide an interference fit with a corresponding part of the cleaning element, and a former adapted to cooperate with said deformable fastener (iv) positioning the cleaning element within the slot to abut and overlie at least one edge thereof, (v) positioning the fastener assembly in the slot so that the component is properly juxtaposed with the corresponding part of the cleaning element within the slot and in abutment with an edge of the slot, (vi) assembling the deformable fastener and former upon the component such that the deformable fastener is positioned within the slot, and (vii) deforming the deformable fastener upon the component using the former to fix the cleaning element into the slot.

Preferably the step of providing a fastener assembly comprises provision of a fastener member having a head, a shank with a configured end and a deformable fastener ring adapted to fit closely over the shank, and a press-fit collar adapted to deform the deformable fastener ring upon the configured end of the shank when assembled.

Preferably the deforming step is effected by applying a compressive force to the ring axially along the shank against the collar to thereby form an interference fit to lock the collar to the shank. Those skilled in the art will be familiar with means for applying compressive force to deform the ring against the collar, e.g. by use of a "G"-clamp, or hydraulic clamping tool adapted to exert "push" against an end-face of the shank until the ring is sufficiently deformed to form an interference fit between the shank, and the collar, and preferably until the ring is pressed flush with the end of the shank.

A step of replacing a cleaning element is achievable by shearing the deformable ring to release the fastener assembly, and releasing the cleaning element from the slot.

Preferably the shearing step is effected by applying a driving tool to the end of the shank to which the ring is fitted, and applying sufficient axial force along the shank whereby the shank is driven out of the slot as the ring is sheared.

It will be understood that references herein to ferrous material are to materials containing iron such as metal cuttings, shavings, chips, dislodged rust or the like which are found downhole, such as may be produced during downhole procedures. Such ferrous materials may, for example, be produced during drilling or milling of a window in a casing or liner, or may be dislodged during a cleaning operation.

It will also be understood that the tool serves for cleaning ferrous material from a wellbore in that the magnet generates a magnetic field which attracts ferrous material present in the wellbore towards the tool. Thus by translating the tool relative to the wellbore (with the magnet in the activated position), the magnet may cause ferrous materials in the wellbore to become attracted towards and thus adhered to the tool, thereby facilitating removal of the ferrous material from the wellbore.

Preferably, the tool comprises a plurality of magnets. In particular embodiments, the tool may comprise at least one set of magnets, the set comprising a plurality of magnets spaced around a circumference of the tool main body. The magnets in the set may be mutually equidistantly spaced around the circumference of the main body. In particular preferred embodiments, the tool comprises a plurality of such sets of magnets, the sets relatively spaced in a direction along an axial length of the tool main body. The magnets in adjacent sets may be circumferentially aligned with corresponding magnets in an adjacent set or sets, or may be staggered. This may facilitate creation of a spread magnetic field in use of the tool.

In variants, selected magnets are absent or shielded on either side of a channel aligned with the axial length of the tool main body, so that such a channel does not collect ferrous debris and thus offers improved fluid flow past the tool.

The tool may comprise a plurality of magnetic subs each housing or defining a respective magnet. The magnetic subs may be mounted on or around a common inner mandrel, or each may comprise a respective inner mandrel, and the inner mandrel of one magnetic sub may be coupled to a corresponding mandrel of an adjacent sub. Thus where the tool comprises three such magnetic subs, the inner mandrel of a first or upper sub may be coupled to a second sub, and the inner mandrel of the second sub may be coupled to a respective mandrel of a third sub.

DESCRIPTION OF THE DRAWINGS

Embodiments of the present invention will now be described, by way of example only, with reference to the accompanying drawings, in which:

FIG. 1(*b*) is an enlarged view of the tool illustrated in FIG. 1(*a*).

FIG. 1(*c*) is a sectional view of the cleaning tool of FIG. 1(*a*) taken about the line A-A of FIG. 1(*a*);

FIG. 1(*d*) is a sectional view of the cleaning tool of FIG. 1(*a*) taken about the line B-B of FIG. 1(*a*);

FIG. 1(*e*) is a sectional view of the cleaning tool of FIG. 1(*a*) taken about the line C-C of FIG. 1(*a*);

FIG. 2(*b*) is an enlarged perspective view of a slotted rib shown in FIG. 2(*a*) showing detail of chamfered seat areas around slot;

FIG. 3(*b*) shows an exploded sectional view of the magnetic element and fastener assembly of FIG. 3(*a*) showing relative positioning of components of fastener assembly juxtaposed with magnetic element prior to assembly;

FIGS. 3(*c*)-(*e*) show the steps of assembly of a magnetic element and fastener assembly as shown in FIG. 3(*a*)

MODES FOR PERFORMANCE OF THE INVENTION

Figure 1A:
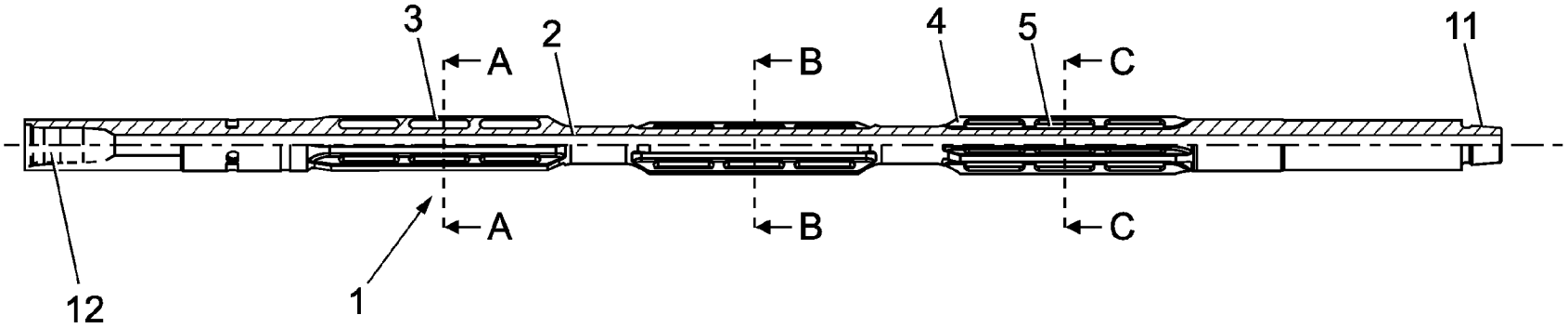
FIG. 1(*a*) is a longitudinal half-sectional view of an embodiment of a cleaning tool of this invention, for use in cleaning ferrous material from a wellbore.
Figure 1B:
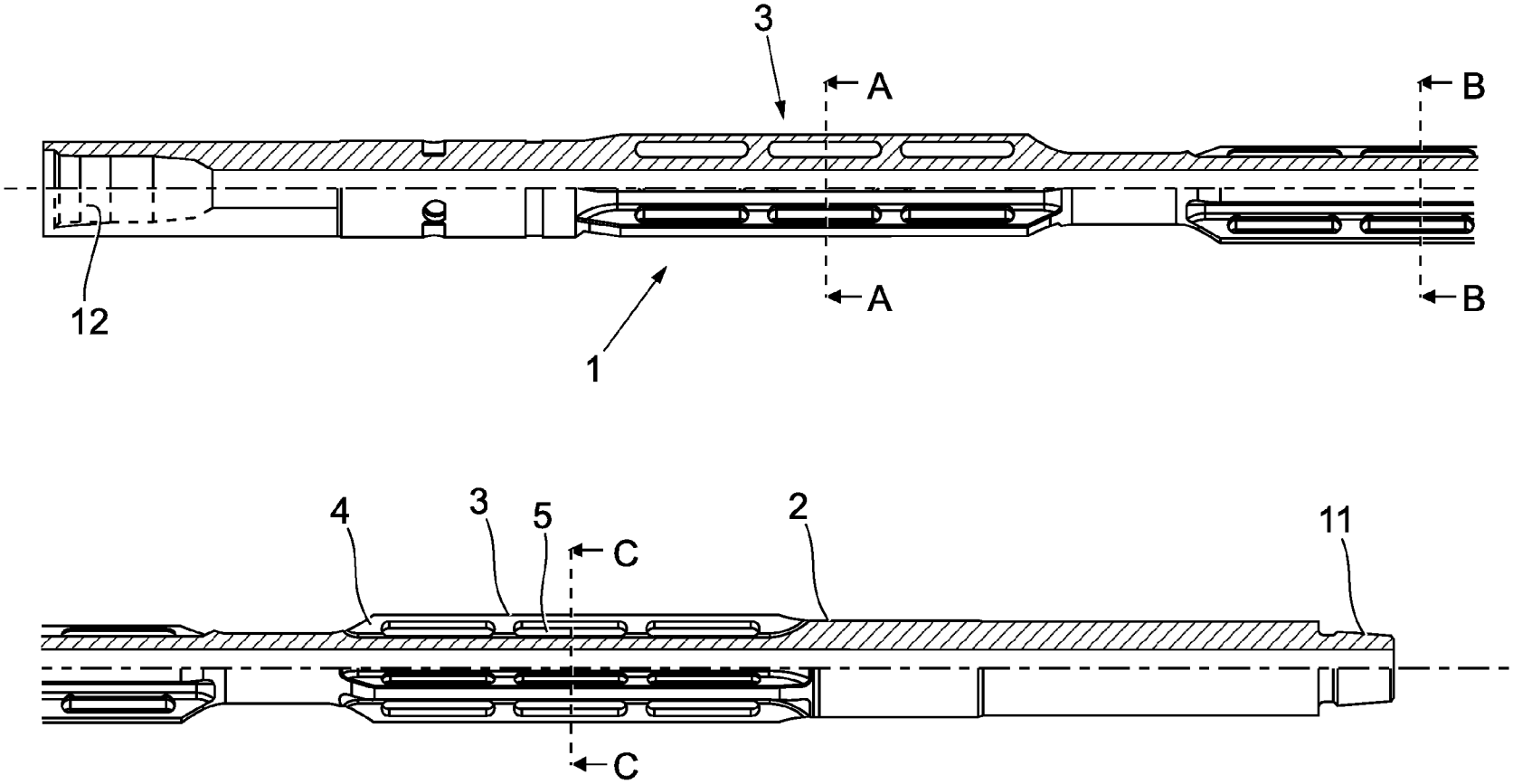
Figure 1C:
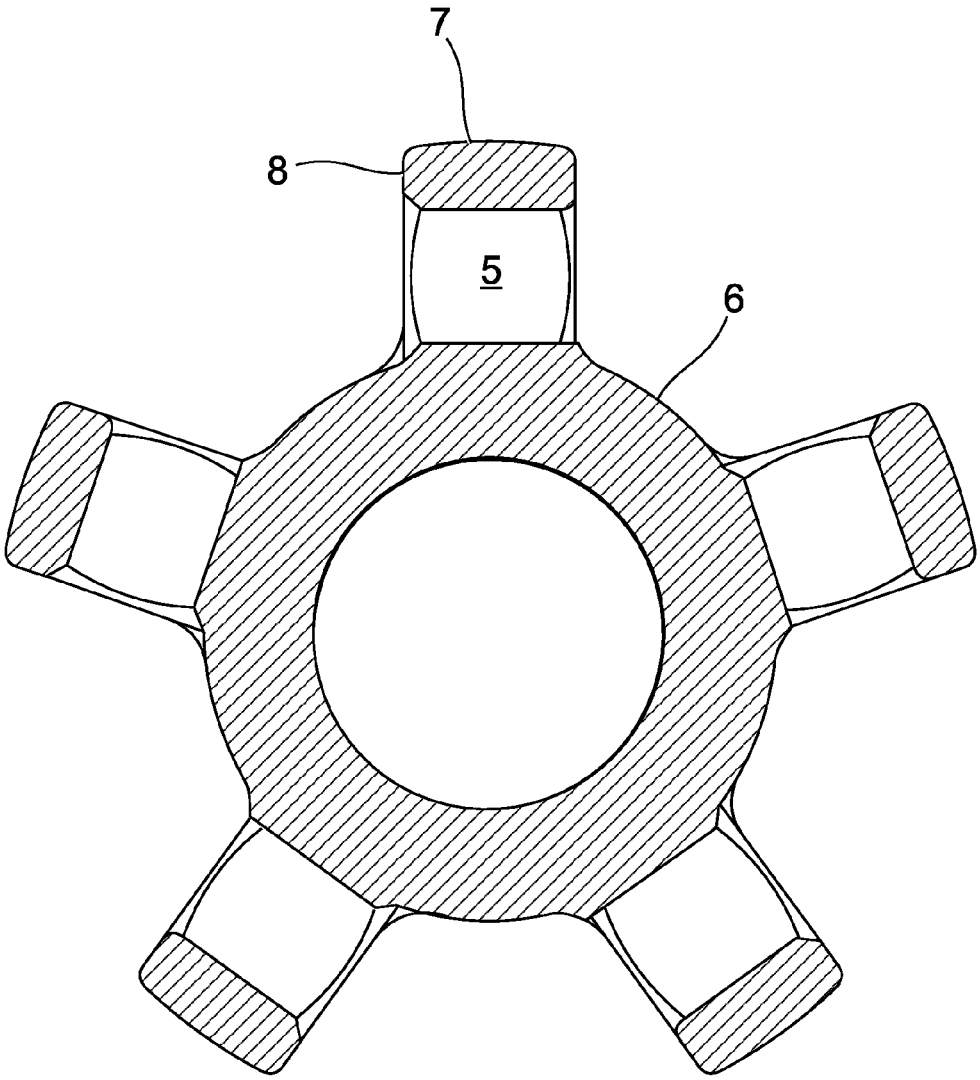
Figure 1D:
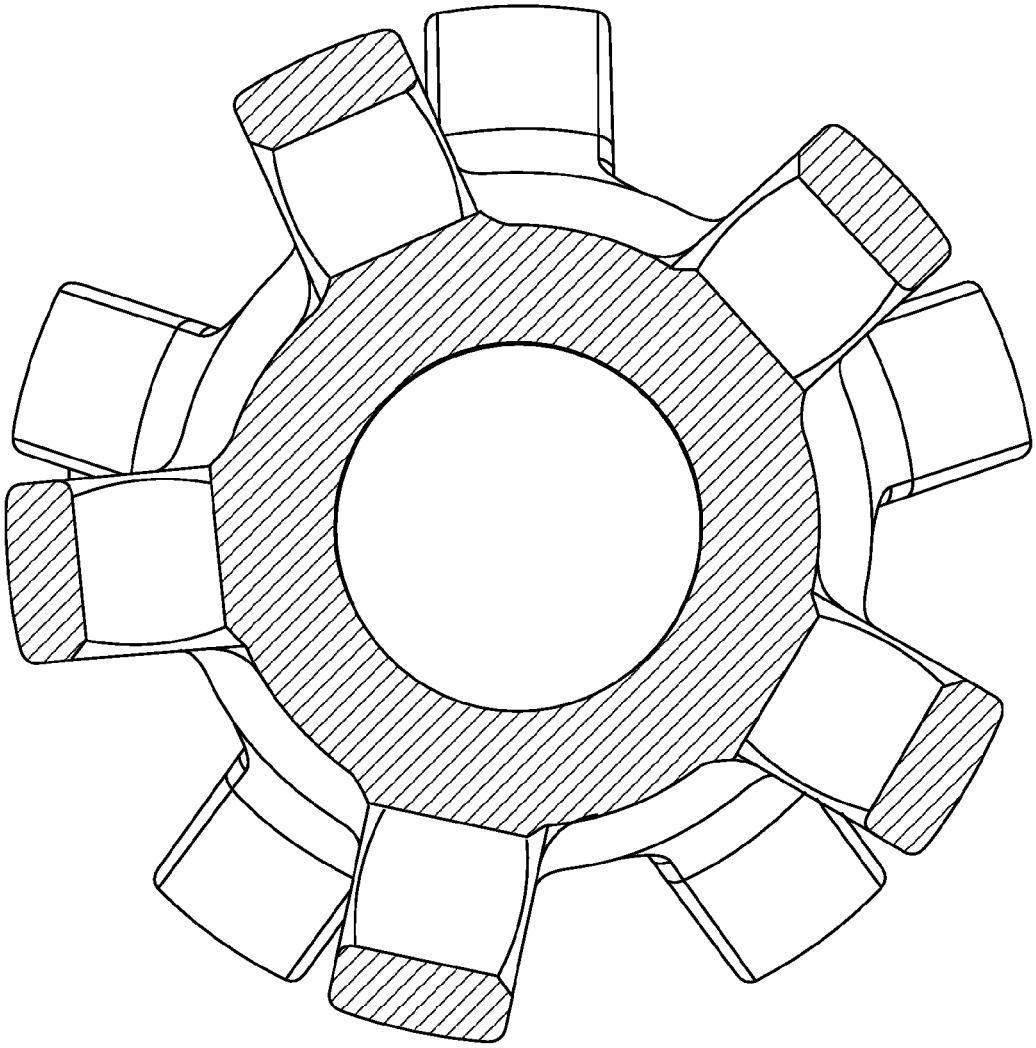
Figure 1E:
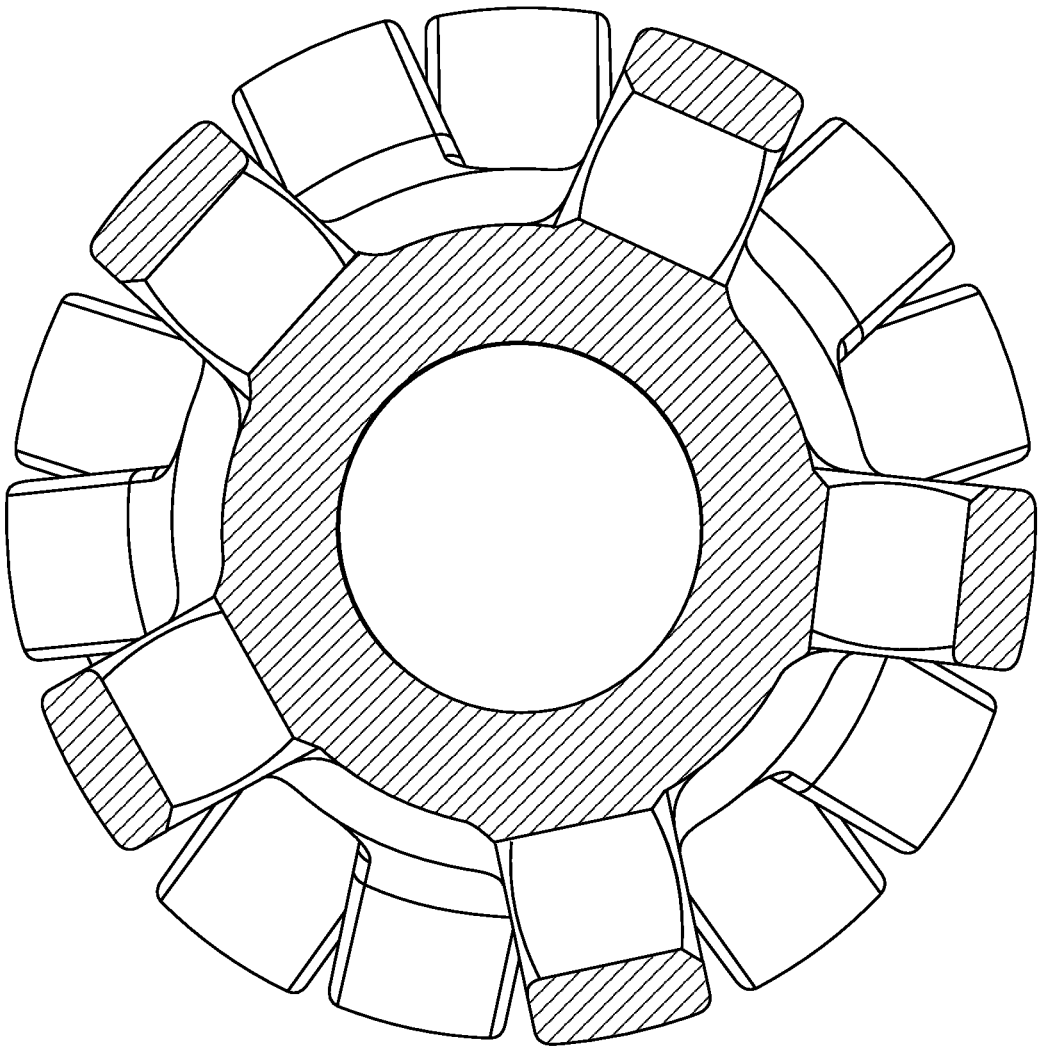

Turning firstly to FIGS. 1(*a*)-(*d*), there is shown a longitudinal half-sectional view of a cleaning tool for use in cleaning ferrous material from a wellbore (not shown) and sections through cleaning elements on the tool.

The tool which is indicated generally by reference numeral 1 is provided with pin 11 and box 12 sections as is conventional in the art to enable the tool to be removably incorporated in a work string (not shown).

The tool comprises a tool body 2, provided with cleaning structures indicated generally by reference numeral 3. Each cleaning structure comprises radially extending ribs 4, each of which is provided with elongate slots 5 for receiving cleaning elements, which for present purposes are magnetic elements (not shown in FIG. 1).

Figure 2A:
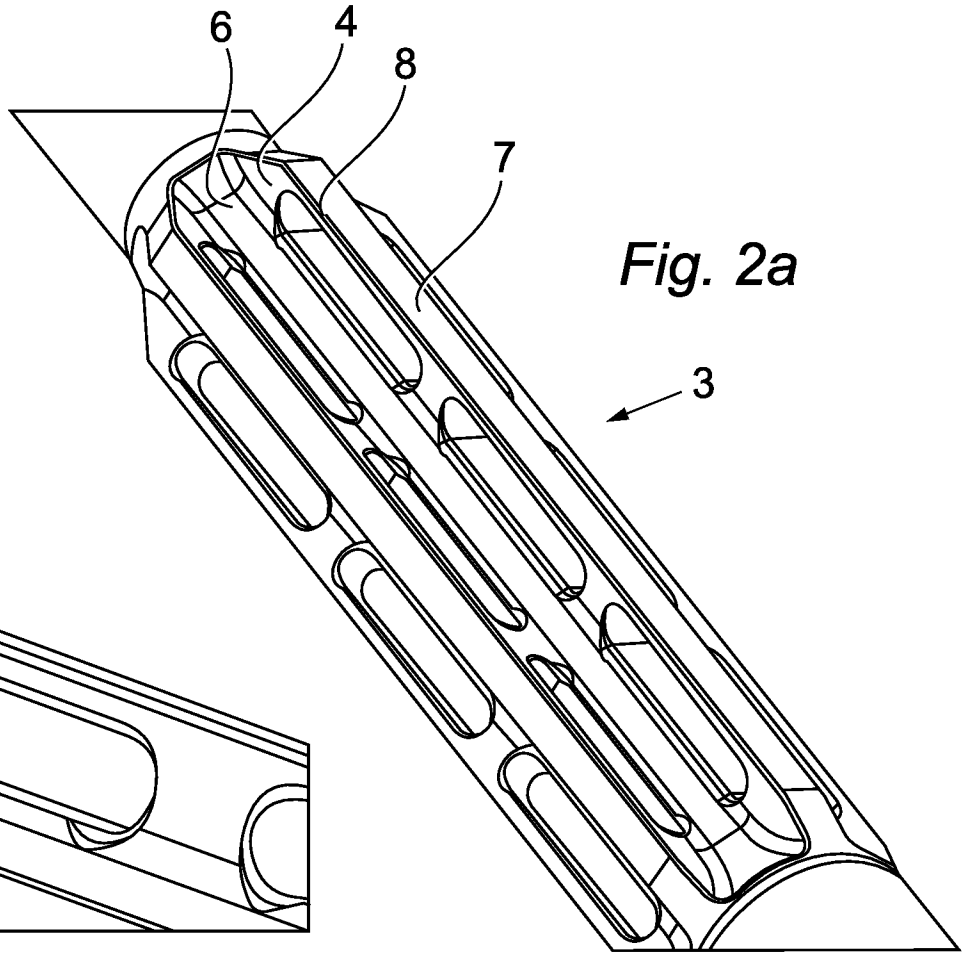
FIG. 2(*a*) is a perspective view of a ribbed sub forming part of a cleaning tool according to an embodiment of the invention, showing recesses between slotted ribs (magnets removed)
Figure 2B:
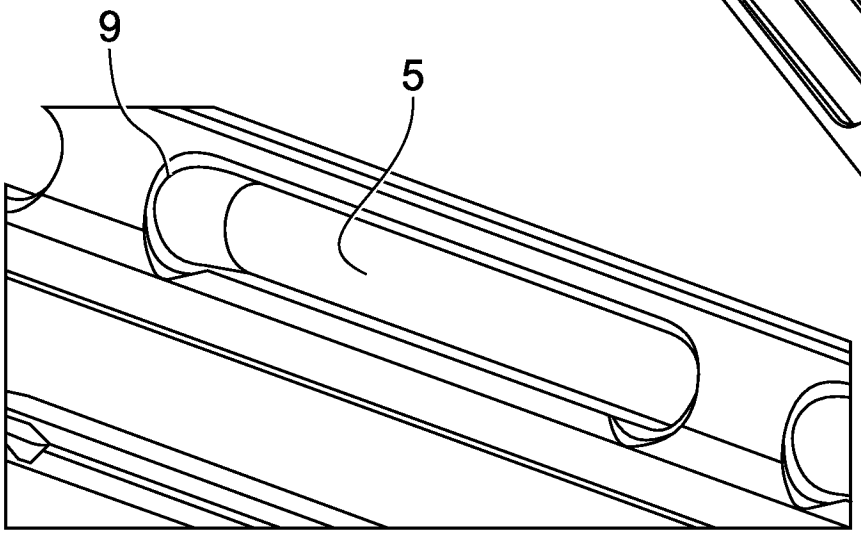
Figure 3A:
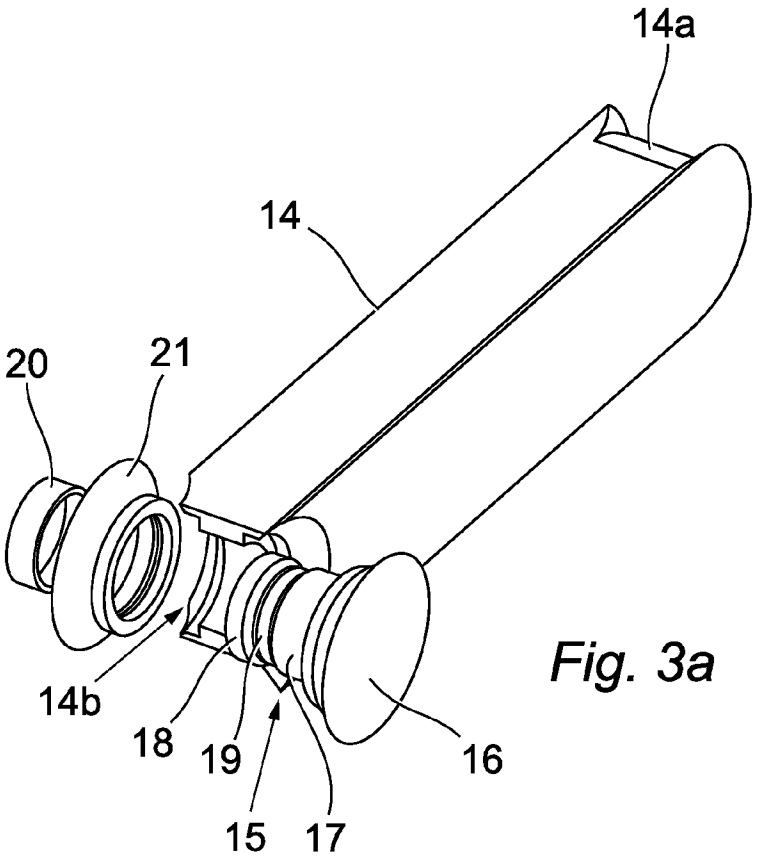
FIG. 3(*a*) shows an exploded perspective view of a magnetic element and fastener assembly.
Figure 3B:
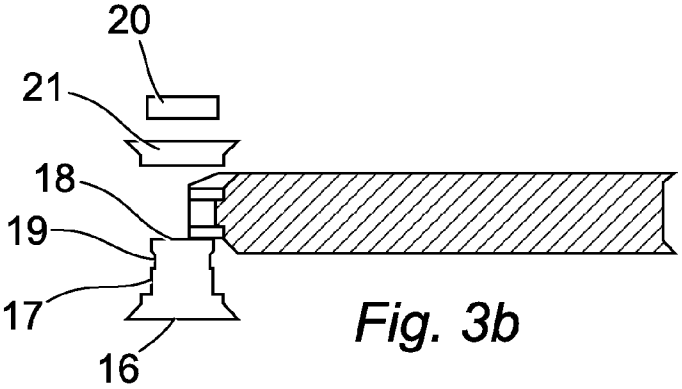
Figure 3C:
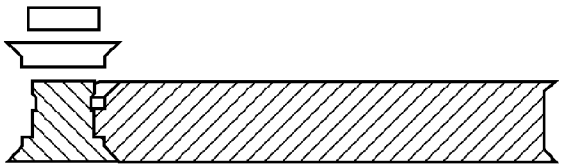
Figure 3D:
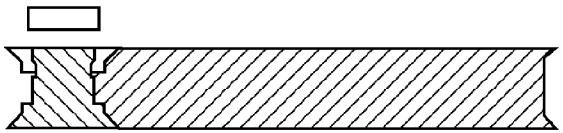
Figure 3E:
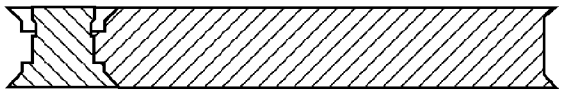

Referring now to FIG. 2(*a*), the detail of a preferred cleaning sub is shown, wherein, each rib 4 has a recessed surface 6 adjacent the root or base of the rib, and at its radially outermost periphery, a surface 7 with edges 8 on either side. Each rib tapers at either end to merge with the tool body surface. The ribs each have a series of the aforesaid elongate slots 5 (three in this embodiment but more or less may be used, and differing ribs, e.g. shorter or longer, may have a different number of slots in other situations).

Further detail of the preferred slots 5 is shown in FIG. 2(*b*) which shows an enlarged perspective view from above and to one side of a slotted rib. The slot 5 has contoured edges especially chamfered semi-circular edges 9 at either end of the slot.

The slot is shaped thus to receive a magnetic element and fastener assembly as shown in FIG. 3(*a*).

Referring to FIG. 3(*a*), a magnetic element 14 comprises an elongate shaped casing adapted to seat in a slot (such as that shown in FIG. 2(*b*)), and having curved ends. In this embodiment, one curved end 14*a* is configured to seat closely into an end of the recess 5, and the other end 14*b* is recessed to accommodate a fastener assembly 15.

The fastener assembly 15, referring to FIG. 3(*b*), comprises a fastener member having a head 16, a shank 17 with a configured end 18 and a deformable fastener ring 20 adapted to fit closely over the shank, and a collar 21 adapted to deform the deformable ring upon the configured end of the shank when assembled. Conveniently the deformation involves compression of the ring into one (or more) groove(s) 19 in the configured end 18 of the shank 17. This assembly allows a swaging technique to be used to fasten the magnetic element within the rib and thereby securely mount the magnetic elements to the tool body. Thus the fastener assembly may comprise a retention pin (fastener member—16, 17, 18, 19), a swage ring (deformable fastener ring 20), and a swage cup (collar 21).

The respective head 16 and collar 21 of the fastener assembly are flanged to permit an interference fit with a corresponding part of the tool body to allow the fastener assembly to retain the magnetic element in position upon the body. The flange is bevelled to abut a corresponding chamfered seat in a contact surface in the tool body as well as allowing the flush-fitting of the fastener assembly into the magnetic element which is valuable in avoiding fluid flow disturbance.

Figure 4:
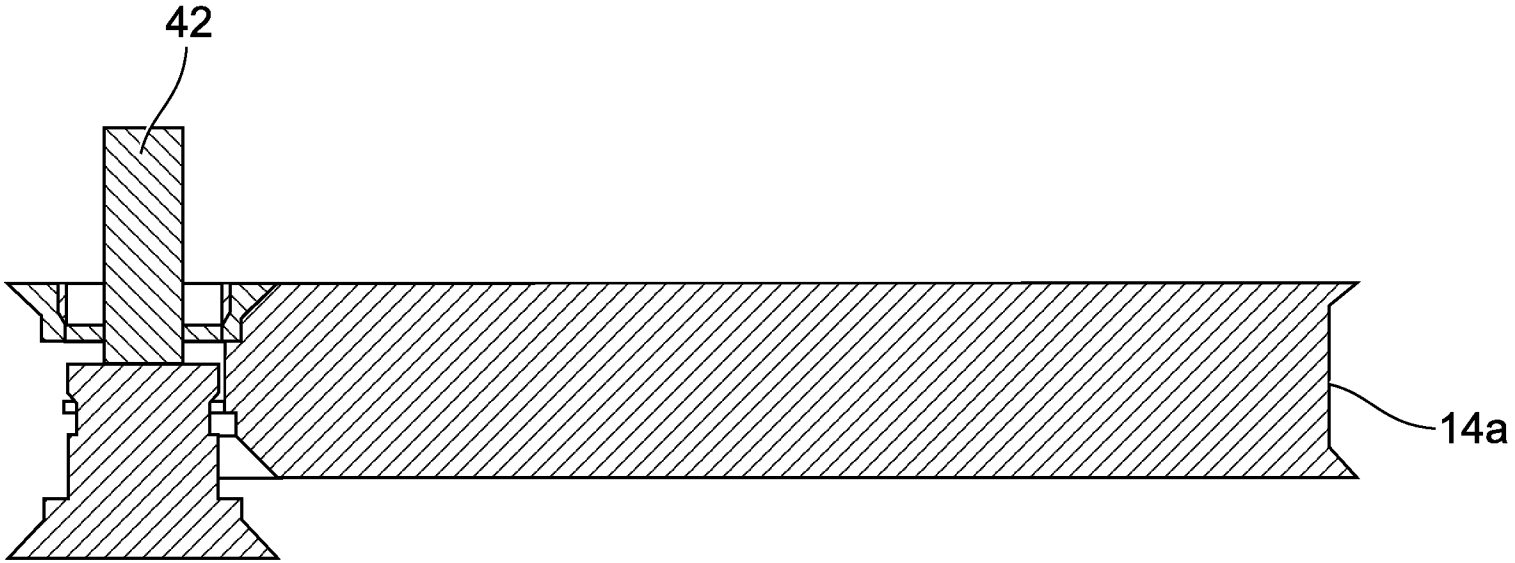
FIG. 4 shows a disassembly procedure using a rod-shaped driving tool.

If it is desired to disassemble the tool to remove damaged magnetic elements for example, then the deformed ring can be sheared and removed by applying a driving tool 42 to that end of the shank of the fastener member, to which the ring is fitted, and applying sufficient axial force along the shank whereby the shank is driven out of the slot as the ring is sheared as illustrated schematically in FIG. 4. Re-assembly simply requires provision of a new deformable ring.

Optional modifications to the illustrated embodiment include provision of elements that are adapted to be inserted in the recess normally intended to receive cleaning element, but are in fact merely blanking or magnetic shielding elements. In such an embodiment one or more selected channels between radially extending ribs serve, not as ferrous debris catchment areas, but as fluid flow past channels. Such selected flow past channels may offer advantages if there is a need to retrieve the tool quickly during a POOH run or use in a hole where flow restriction may be anticipated to be problematic.

Industrial Applicability

In a typical use of the cleaning tool, it is provided as part of a tool string run into the wellbore and may, for example, form part of a drilling or milling string (not shown) which may for example include jetting, milling or other tool functions.

Various modifications may be made to the foregoing without departing from the scope of the present invention as defined by the claims.

The invention claimed is:

1. A cleaning tool for use in cleaning ferrous material from a wellbore, the cleaning tool comprising:

a tool main body; and at least one magnetic element mounted on the tool, wherein said at least one magnetic element is mounted by retention means comprising a deformable fastener, wherein said deformable fastener is part of a fastener assembly comprising the deformable fastener, a component adapted to provide an interference fit with a corresponding part of a magnetic element, and a former adapted to cooperate with said deformable fastener, and wherein said fastener assembly comprises a fastener member having a head, and a shank with a configured end and a deformable fastener ring adapted to fit over the shank, and a press-fit collar adapted to deform the deformable fastener ring upon the configured end of the shank when assembled.

2. A cleaning tool as claimed in claim 1, wherein the retention means comprises a component which passes through an outer surface of the tool, the component having a portion upon which the deformable fastener is positioned and locked by deformation of the deformable fastener.

3. A cleaning tool as claimed in claim 1, wherein the configured end of the shank has a structure about which the fastener ring may be deformed during an assembly step to form an interference fit between the collar and the shank.

4. A cleaning tool as claimed in claim 1, wherein the configured end of the shank comprises at least one groove, and the deformable ring is positionable upon the shank for assembly purposes such that a compressive force upon the ring causes its deformation into said at least one groove.

5. A cleaning tool as claimed in claim 4, wherein the assembly is such that a compressive force applied upon the ring axially along the shank forces the ring to deform against the collar and thereby form an interference fit between the shank and collar to lock the collar to the shank.

6. A cleaning tool as claimed in claim 4, wherein the material of the ring is selected such that the deformation is substantially permanent.

7. A cleaning tool as claimed in claim 1, wherein the magnetic element is configured for mounting upon the tool by provision of a recess associated with said element such that the deformable fastener is locatable within said recess.

8. A cleaning tool as claimed in claim 7, wherein the recess is provided in an end of a casing housing the magnetic element.

9. A cleaning tool as claimed in claim 7, wherein the recess is provided in an end of the magnetic element.

10. A cleaning tool as claimed in claim 1, wherein the tool body is configured to facilitate fluid flow around the magnetic elements.

11. A cleaning tool as claimed in claim 10, wherein the magnetic elements are mounted in projecting parts of the tool body, said parts having recessed catchment areas therebetween.

12. A cleaning tool as claimed in claim 11, wherein the projecting parts are ribs extending from a side surface of the tool body.

13. A cleaning tool as claimed in claim 12, wherein the ribs extend radially from the tool body.

14. A cleaning tool as claimed in claim 12, wherein the ribs are configured to provide peripheral surfaces that serve as tool body stabiliser surfaces.

15. A cleaning tool as claimed in claim 12, wherein the ribs are aligned with the longitudinal axis of the tool body.

16. A cleaning tool as claimed in claim 12, wherein the tool body is provided with several groups of ribs spaced along the longitudinal axis of the tool body.

17. A cleaning tool as claimed in claim 16, wherein the respective groups are radially offset.

18. A cleaning tool as claimed in claim 11, wherein at least one slot is provided in a projecting part of the tool body to mount the magnetic element therein.

19. A cleaning tool as claimed in claim 18, wherein the slot is configured to receive the magnetic element together with a fastener assembly such that parts of the fastener assembly abut edges of the slots to retain the magnetic elements in position.

20. A cleaning tool as claimed in claim 19, wherein the fastener assembly comprises a fastener member having a head, and a shank with a configured end and a deformable fastener ring adapted to fit closely over the shank, and a press-fit collar adapted to deform the deformable fastener ring upon the configured end of the shank when assembled, and wherein the respective head and collar are each flanged to permit an interference fit with a corresponding contact surface of the tool body around said slot.

21. A cleaning tool as claimed in claim 20, wherein the flange is bevelled, and the corresponding contact surface in the tool body comprises a chamfered seat.

22. A cleaning tool as claimed in claim 18, wherein the slot is configured to receive a magnetic element together with a fastener assembly such that peripheral edges of the element overlie edges of the slot.

23. A cleaning tool as claimed in claim 11, wherein the tool body comprises a plurality of subs.

24. A cleaning tool as claimed in claim 23, wherein each sub is provided with differently oriented supports for magnetic elements.

25. A cleaning tool as claimed in claim 23, wherein the supports comprise ribs that extend radially from the tool body, and each sub is provided with a group of ribs, and the respective groups are radially offset.

26. A method of assembling a downhole wellbore cleaning tool to provide a concealed secure fixing for a cleaning element, which method comprises:

providing a tool body part, said part having at least one projecting support bearing a slot for receiving a cleaning element, providing a cleaning element configured to fit within the slot providing a fastener assembly comprising a deformable fastener, a component adapted to provide an interference fit with a corresponding part of the cleaning element, and a former adapted to cooperate with said deformable fastener, positioning the cleaning element within the slot to abut and overlie at least one edge thereof, positioning the fastener assembly in the slot so that the component is juxtaposed with the corresponding part of the cleaning element within the slot and in abutment with an edge of the slot, assembling the deformable fastener and former upon the component such that the deformable fastener is positioned within the slot, and deforming the deformable fastener upon the component using the former to fix the cleaning element into the slot, wherein providing a fastener assembly comprises providing a fastener component having a head, and a shank with a configured end and a deformable fastener ring adapted to fit closely over the shank, and a press-fit collar adapted to deform the deformable fastener ring upon the configured end of the shank when assembled, and the step of assembly comprises positioning the deformable ring about the end of the shank to contact the collar, and deforming the ring to create an interference fit upon the configured end of the shank.

27. A method as claimed in claim 26, wherein the step of providing a fastener assembly comprises providing a fastener component wherein the configured end of the shank has at least one groove, and the step of assembly comprises positioning the deformable ring upon the shank over said at least one groove, and compressing the ring to cause its deformation into said at least one groove.

28. A method as claimed in claim 27, wherein the step of assembly comprises applying a compressive force to the ring axially along the shank against the collar to thereby form an interference fit to lock the collar to the shank.

29. A method as claimed in claim 27, comprising the step of replacing a cleaning element by shearing the deformable ring to release the fastener assembly, and releasing the cleaning element from the slot.

30. A method as claimed in claim 29, wherein the shearing step is effected by applying a driving tool to the end of the shank to which the ring is fitted, and applying sufficient axial force along the shank whereby the shank is driven out of the slot as the ring is sheared.

* * * * *